US006262671B1

(12) United States Patent
Nakano

(10) Patent No.: US 6,262,671 B1
(45) Date of Patent: Jul. 17, 2001

(54) PAGER HAVING BAR CODE READER

(75) Inventor: Yasushi Nakano, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 07/801,659

(22) Filed: Dec. 2, 1991

(30) Foreign Application Priority Data

Nov. 30, 1990 (JP) ..... 2-336532

(51) Int. Cl.[7] ..... H04G 1/00

(52) U.S. Cl. ..... 340/825.44; 455/38.1; 359/153

(58) Field of Search ..... 340/825.44, 815.21; 455/38.1; 379/57; 359/153, 161, 145; 235/462

(56) References Cited

U.S. PATENT DOCUMENTS 4,247,908 * 1/1981 Lockhart ..... 455/38.1
4,392,135 7/1983 Ohyagi ..... 340/825.44
4,503,288 * 3/1985 Kessler ..... 379/51
4,621,259 * 11/1986 Schepers ..... 340/707
4,780,910 * 10/1988 Huddleston ..... 359/145
4,825,200 * 4/1989 Evans ..... 359/146
4,916,441 * 4/1990 Gombrich ..... 340/825.44
5,105,179 * 4/1992 Smith ..... 340/815.2
5,157,687 * 10/1992 Tymes ..... 235/462

* cited by examiner

*Primary Examiner*—Donald J. Yusko
*Assistant Examiner*—Brian Zimmerman
(74) *Attorney, Agent, or Firm*—Foley & Lardner

(57) ABSTRACT

A pager includes a bar code reader, which reads from a function setting bar code list functional data to be set to a pager and which stores the data in the ROM. Since the function setting data is read from the bar code, the ROM writer is unnecessary when the user changes the function. The user need only prepare a function setting bar code list and is hence relieved from inconvenience to bring the pager to the service firm. In addition, the electrodes for the connection between the pager and the ROM writer and hence the seal covering the electrodes are unnecessary, which simplifies the structure of the pager.

2 Claims, 3 Drawing Sheets

PAGER HAVING BAR CODE READER

BACKGROUND OF THE INVENTION

The present invention relates to a pager, and in particular, to a pager whose functions can be easily set.

DESCRIPTION OF THE PRIOR ART

A conventional pager has a read-only memory (ROM) disposed therein. The ROM is used to store therein pager functional data indicating a processing method and a notifying method of a selective calling code identifying the pager and digital signals transmitted as a message after the selective calling signal. Reference is made to U.S. Pat. No. 4,392,135 which is assigned to the same assignee as the present application.

In order to store the functional data in the ROM, according to the conventional method, a ROM writer 205 is electrically connected via a connection cable 206 to a pager 201 as shown in FIG. 4 such that when a signal is inputted from the ROM writer 205 to the pager 201, the functional data is stored in the ROM disposed in the pager 201.

In this example, a battery case cover 202 disposed in a portion of the pager 201 is removed therefrom and then a connector 204 coupled to the connection cable 206 is connected to a connector 203 disposed in the cover 202.

In the conventional pager of this kind, a ROM writer as an external equipment is necessitated to set the pager function. Since such a ROM writer is expensive, when a function of the operation of a pager is desired to be changed, the user of the pager is required to bring the pager to a paging dealer or operating company. Namely, there has been a problem that the function of the pager cannot be easily altered.

Moreover, since the ROM writer is electrically connected to the pager, it is necessary to dispose a terminal in the pager for the connection. When the terminal is mounted in an outer surface of a case of the pager, the terminal portion made of a metal is exposed to an external space. Resultantly, the operation of the pager is likely to be hindered by an external disturbance such as a static electricity. To avoid such a disturbance, some pagers are provided with countermeasure, for example, a protective label is fixed onto the terminal portion or the terminal is disposed in the pager to be covered by the battery case as shown in FIG. 4. However, when resetting a function of the pager, the user is required to remove the label or to open the battery case, which leads to a problem of a deteriorated operation efficiency.

SUMMARY OF THE INVENTION

It is therefore an object of the present invention to provide a pager in which functional data can be easily changed, thereby solving the problems above.

In accordance with the present invention, there is provided a pager comprising receiver means for receiving a paging signal including an address of the pager and a message to produce a received signal, compare means response to said received signal for comparing the address with a preassigned address to produce a coincidence signal when the two address are coincident with each other, annunciate means responsive to the coincidence signal for annunciating a call, means for storing therein the preassigned address and functional data of the pager associated with the processing and the annunciation, and bar code read means for reading bar code data from a function setting bar code and storing the content of the bar code data into the storing means. In accordance with the present invention, the functional data can be set to the ROM.

Furthermore, in accordance with the present invention, the pager further comprises a display unit for displaying a received message, a light receiving unit for detecting an ambient brightness to automatically turn a display illuminator on, the display illuminator being included in the display unit, and a light emitting unit as notifying means. In the pager of this kind, the light emitting unit irradiates a light onto a bar code, the light receiving unit receives a signal for a bar code reading, and the bar code reader unit reads bar code information sent from the light receiving unit.

BRIEF DESCRIPTION OF THE DRAWINGS

The objects and features of the present invention will become more apparent from the consideration of the following detailed description taken in conjunction with the accompanying drawings, in which.

DESCRIPTION OF THE PREFERRED EMBODIMENTS

Figure 1:
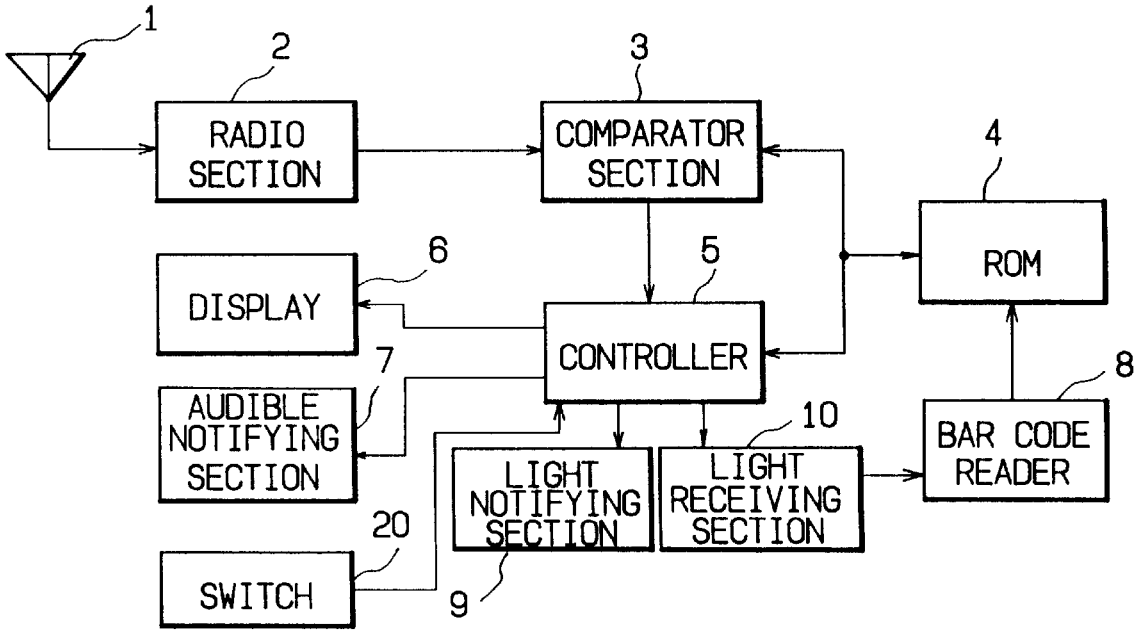
FIG. 1 is a schematic block diagram showing an embodiment of a pager in accordance with the present invention.

Referring now to the drawings, a description will be given in detail of a method and an apparatus in accordance with the present invention.

FIG. 1 shows an embodiment of a pager according to the present invention. The pager has an antenna 1. A radio frequency (RF) signal received by the antenna 1 is delivered to a radio section 2. The RF signal received from the antenna 1 ordinarily includes a selective calling code or a paging code and a message following the code. The radio section 2 subjects the inputted RF signal to an amplification, a frequency conversion, a demodulation, and a digital signal conversion to output a resultant signal to a comparator section 3. The comparator section 3 compares a selective calling number included in the resultant signal with a preassigned calling number stored in a ROM 4. When the two numbers coincide with each other, the comparator section 3 outputs a control signal to a controller 5.

The controller 5 includes a decoder and a central processing unit (CPU), the decoder and the CPU being associated with the ROM 4. In response to the control signal, the decoder controls an audible notifying section 7 and a light notifying section 9 depending on a function set in the ROM 4. The audible notifying section 7 may be comprised of a speaker and a speaker driver, and the light notifying section 9 may be comprised of a light emitting diode (LED) and a LED driver. Moreover, when the selective calling signal of the own pager is followed by a message signal, the controller 5 processes the message signal according to the function set in the ROM 4 to extract a message therefrom and presents the message on the display section 6. The controller 5 is connected to a light receiving section 10 including a photo sensor, which detects an ambient brightness. When the ambient brightness is below a predetermined level, the controller 5 activates an illuminating function incorporated in the display section 6.

The bar code reader section 8 is connected to the ROM 4 and the light receiving section 10. The LED of the light notifying section 9 illuminates a bar code associated with the function setting bar code list 102 shown in FIG. 2 such that a reflection light thereof is received by the light receiving section 10 and the bar code reader 8 reads the bar code based on a signal thus obtained. The bar code includes functional data indicating, for example, the methods of processing, notifying, and displaying the selective calling code and the digital signal. The functional data is stored in the ROM 4.

A switch 20 is manually operable to select two modes of controller 5 i.e. a receiving mode and a bar code reading mode. In the receiving mode, the controller 5 makes the light notifying section 10 function as a light notifying device for a call. In the bar code reading mode, the controller 5 makes the light notifying means 9 function as a bar code light. Thus, in this embodiment, the light notifying section 9 selectively functions either as the light notifying device or bar code light.

Figure 2:
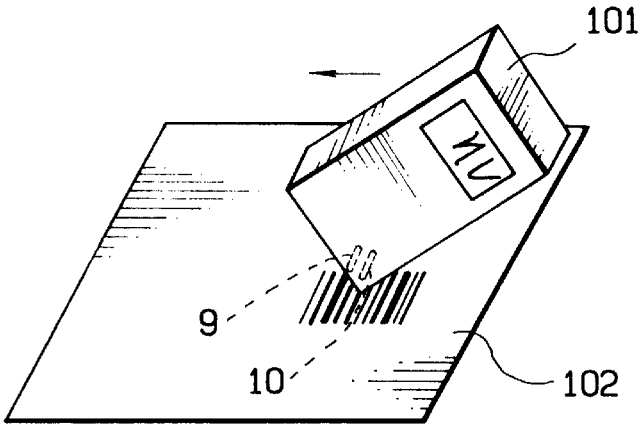
FIG. 2 is a perspective view showing the pager function setting operation of the FIG. 1 pager.

FIG. 2 shows a state of a bar code reading operation. Although not shown, in an end portion of a bottom surface of the pager 101, the LED of the light notifying section 9 and the photosensor of the light receiving section 10 are arranged to oppose each other. When the function setting bar code list 102 is scanned by the end portion, a bar code is read from the bar code list 102. As a result, the various functions are set in the pager 101.

According to the pager, the functional data can be set in the ROM without using a ROM writer. Namely, the ROM writer is unnecessary; moreover, electrodes and connectors necessary for the connection of the ROM writer can also be dispensed with, which consequently solves the problems of the prior art.

Figure 3:
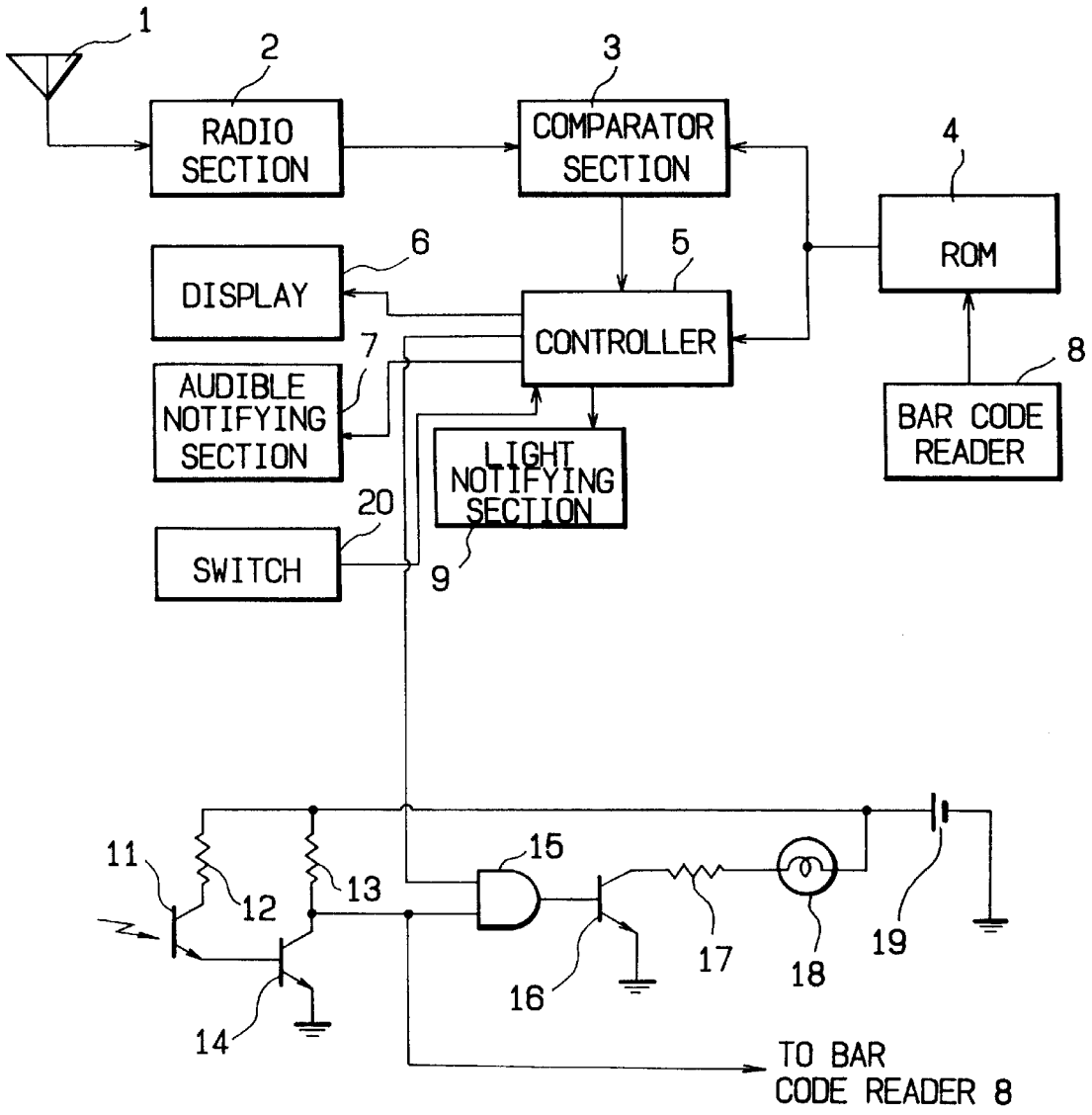
FIG. 3 is a block diagram schematically showing another embodiment of a pager in accordance with the present invention.
Figure 4:
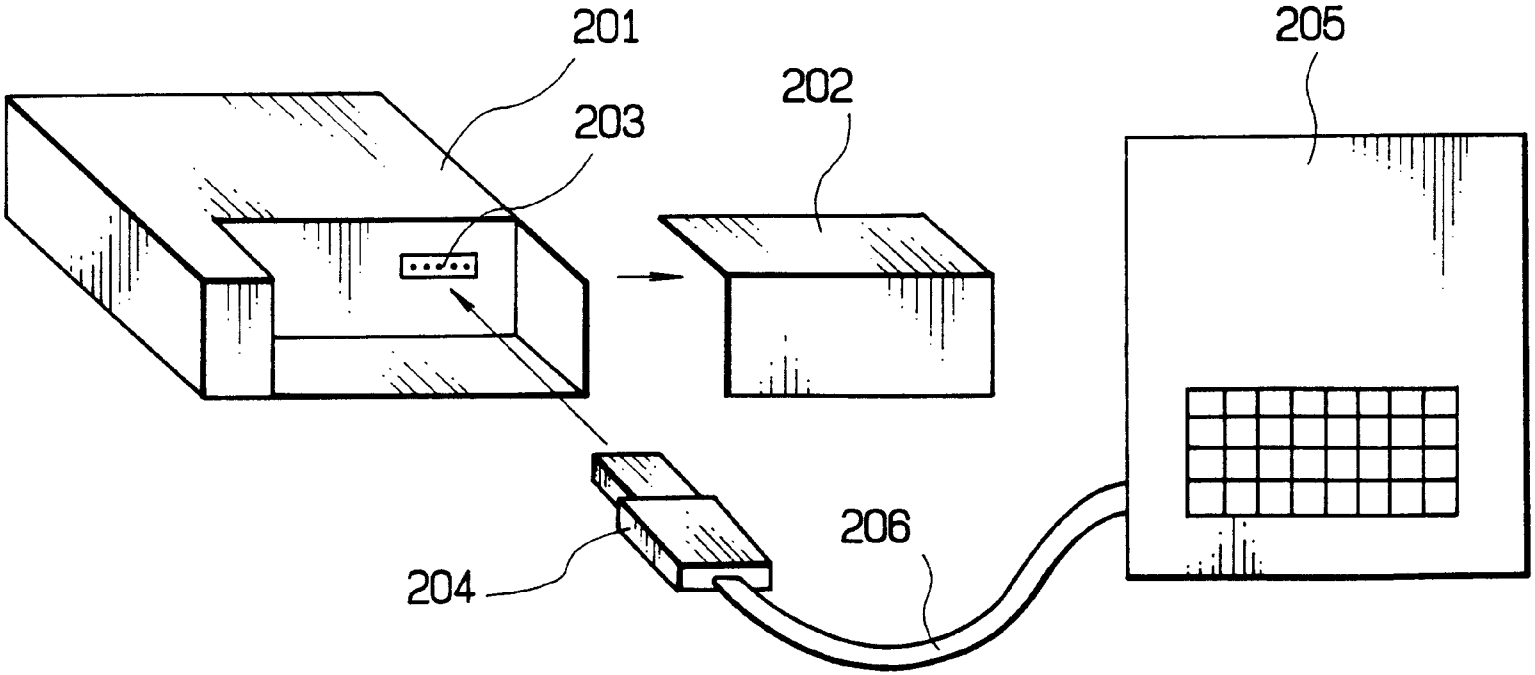
FIG. 4 PRIOR ART
FIG. 4 is a perspective view showing an operation in which a function is set to a conventional pager by an ROM writer.

FIG. 3 shows an alternative embodiment of a pager in accordance with the present invention.

In this embodiment, in the receiving mode, the controller 5 outputs a logical "1" and "0" signals to an AND gate 15 when a message is being and not being displayed respectively. In the bar code reading mode, the controller 5 always outputs a logical "0" signal to the AND gate 15. The pager further includes a phototransistor 11 which selectively functions as either the sensor for detecting an ambient brightness or the sensor for sensing a reflecting light from a bar code. The phototransistor 11 has a collector coupled through a current limiting resistor 12 to a battery 19 and an emitter connected to the base of a transistor 14. The transistor 14 is biased into conduction in response to an emitter current being supplied from phototransistor 11 when it receives light rays from an external source, that is, the ambient brightness and reflecting light from a bar code. The transistor 14 draws current through a resistor 13 when the lighting condition has a luminance which is sufficient to illuminate the display 6. No current is thus generated in the transistor 14 when the display 6 is poorly lit and under this condition the potential V at the collector of the transistor 14 is raised to a logical "1" which enables the AND gate 15. The potential V is also delivered to the bar code reader 8. A second input to the AND gate 15 is supplied from the output of the controller 5. The output of the AND gate 15 is at a logical "1" when the message is displayed while the luminance is low and turns on a transistor 16, drawing a current through a lamp 18 and a resistor 17. The lamp 18 illuminates the display 6 to compensate for the insufficient luminance. The potential V is also applied to the bar code reader 8 instead of the output of light receiving section 10 (FIG. 2).

In this regard, without employing the AND gate 15, the collector of the transistor 14 may be directly connected to the base of the transistor 16 so that the lamp 18 is lighted only depending on the ambient brightness.

As can be seen the foregoing, the phototransistor 10 serves as not only means for detecting an ambient brightness of the pager but also means for reading the bar code. The controller 5 is connected to the switch 20. Only when the user operates the switch 20, the phototransistor 10 functions as the bar code reader means. Otherwise, the phototransistor 10 functions as the means for detecting the ambient brightness. In other words, either of a light receiving section for reading the bar code and that for detecting the ambient brightness may be dispensed with.

As above, in accordance with the present invention, the provision of the bar code reader for reading from the function setting bar code list functional data to be set to a pager and storing the data in the ROM unnecessitates the ROM writer when changing the pager functions. For an alteration of a function, the user need only prepare a function setting bar code list and is hence relieved from inconvenience, for example, in bringing the pager to an operating firm. In addition, the electrodes for the connection between the pager and the ROM writer and hence the structure covering the electrodes are unnecessary, which simplifies the configuration of the pager.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A pager comprising:

receiver means for receiving a paging signal, including a pager address and a message, to produce a received signal;

comparing means responsive to said received signal for comparing said pager address with a preassigned address to produce a coincidence signal when said pager address is coincident with said preassigned address;

annunciate means response to said coincidence signal for annunciating a call;

storing means for storing therein said preassigned address and functional data of said pager associated with the processing and the annunciation; and bar code reader means for reading bar code data from a function setting bar code and storing the content of said bar code data in said storing means, wherein said bar code reader means includes a light receiving section for reading a bar code, wherein said annunciate means includes a light notifying device, and wherein said light notifying device comprises a light emitting diode, said light emitting diode illuminating the bar code.

2. A pager, comprising:

a receiver for receiving a paging signal having a selective calling code and a message following the code and for outputting a received signal;

a comparator for comparing a selective calling number included in the received signal with a preassigned calling number stored in a memory, and outputting a control signal whenever said selective calling number coincides with said preassigned calling number;

a controller connected to said comparator, an audible notifying section and a light notifying section, wherein whenever the selective calling signal of the pager is followed by a message signal, the controller processes the message signal according to a function set stored in the memory to extract a message therefrom and presents the message on a display section, the controller being further connected to a light receiving section;

a bar code reader connected to the memory and the light receiving section, wherein the light notifying section illuminates a bar code associated with a function setting bar code list such that a reflection light thereof is received by the light receiving section and the bar code reader reads a bar code based on a signal thus obtained, said bar code including functional data stored in the memory; and a switch for selecting a receiving mode and a bar code reading mode, wherein, in said receiving mode, the controller makes the light notifying section function as a light notifying device for a call, and in said bar code reading mode, the controller makes the light notifying means function as a bar code light, thereby permitting the light notifying section to selectively function either as the light notifying device or the bar code light.

* * * * *